US008591278B1

(12) United States Patent
Woo et al.

(10) Patent No.: US 8,591,278 B1
(45) Date of Patent: Nov. 26, 2013

(54) METHOD OF MANUFACTURING PDP BUS ELECTRODE

(71) Applicant: E I Du Pont De Nemours and Company, Wilmington, DE (US)

(72) Inventors: Cho Yong Woo, Kanagawa (JP); Sanjuro Inoue, Kanagawa (JP); Tomonori Oki, Kanagawa (JP)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 13/623,527

(22) Filed: Sep. 20, 2012

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.
USPC ..... 445/24; 445/25; 445/72; 313/633; 313/583

(58) Field of Classification Search
USPC ..... 313/582–587, 633; 315/169.1, 169.4; 445/24–25, 72; 345/37, 41, 60, 71
See application file for complete search history.

(56) References Cited

U.S. PATENT DOCUMENTS

2009/0108752 A1 4/2009 Matsuno et al.

*Primary Examiner* — Anne Hines
*Assistant Examiner* — Jose M Diaz

(57) ABSTRACT

A method of manufacturing a PDP bus electrode comprising steps of: (a) applying onto a glass substrate a black paste comprising, based on the weight of the black paste, (i) a black colorant, (ii) a first glass frit having a first softening point, (iii) a second glass frit having a second softening point, (iv) a photopolymerization initiator, (v) a photopolymerizable compound, and (vi) an organic medium; (b) applying onto the applied black paste a white paste comprising a metal powder, glass frit and an organic medium; (c) exposing the applied pastes to light; (d) developing the exposed pastes; and (e) firing the developed pastes with a firing profile having a firing peak temperature, wherein the first softening point is lower than the firing peak temperature and wherein the second softening point is higher than the firing peak temperature.

6 Claims, 1 Drawing Sheet

METHOD OF MANUFACTURING PDP BUS ELECTRODE

FIELD OF THE INVENTION

The present invention relates to a plasma display panel (PDP), more particularly to a PDP bus electrode.

BACKGROUND OF THE INVENTION

The PDP bus electrode is formed by firing a conductive pastes patterned by photolithography method.

US20090108752 discloses the PDP bus electrode which is formed with a white paste and a black paste containing a metal powder, a black colorant, glass frit, photopolymerization Initiator, and photopolymerizable monomer. The softening point of the glass frit is 325 to 700° C. that is lower than the firing peak temperature to melt to adhere to a substrate.

SUMMARY OF THE INVENTION

An object of the present invention is to provide a method of manufacturing a PDP bus electrode having superior blackness and low electrical properties.

An aspect of the present invention is a method of manufacturing a PDP bus electrode comprising steps of: (a) applying onto a glass substrate a black paste comprising, based on the weight of the black paste, (i) 6 to 20 wt % of a black colorant, (ii) 15 to 32 wt % of a first glass frit having a first softening point, (iii) 1 to 10 wt % of a second glass frit having a softening point, (iv) 1 to 10 wt % of a photopolymerization initiator, (v) 6 to 18 wt % of a photopolymerizable compound, and (vi) 30 to 55 wt % of an organic medium; (b) applying a white paste onto the applied black paste; (c) exposing the applied black paste and the applied white paste on the glass substrate to light; (d) developing the exposed black paste and the white paste; and (e) firing the developed black paste and the developed white paste to form a black electrode and a white electrode respectively, wherein the first softening point is lower than the firing temperature and wherein the second softening point is higher than the firing temperature.

Another aspect of the present invention is a PDP front panel comprising the bus electrode formed by the method above.

The PDP bus electrode having superior blackness and low electrical properties can be formed by the present invention.

DETAILED DESCRIPTION OF THE INVENTION

The PDP bus electrode is an electrode formed in a PDP front panel to transmit electrical current as well as to improve contrast of display. The PDP bus electrode is two-layered with a white electrode ensuring the conductivity and a black electrode ensuring the contrast.

Figure 1:
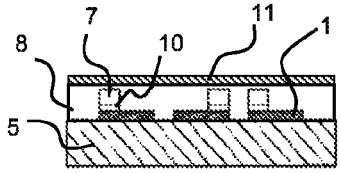
FIG. 1 illustrates the structure of a PDP front panel.

One embodiment of the PDP front panel is illustrated in FIG. 1. The PDP front panel comprises a glass substrate 5, a transparent electrodes 1 formed on the glass substrate 5, a bus electrode including a black electrode 10 formed on the transparent electrode 1, and a white electrode 7 formed on the black electrode 10 in an embodiment. The transparent electrode 1 can be omitted in an embodiment. The PDP front panel further comprises a dielectric coating layer which can be called "Transparent Over Glaze layer" (TOG) 8 to cover the bus electrode and another dielectric coating layer 11 such as MgO coating on the TOG 8 in another embodiment.

The forming method and components of the electrode are respectively described below.

Method of Forming Electrode

The method of manufacturing the bus electrode is explained in detail below along with FIGS. 2A to 2E. The method includes the steps of at least applying, exposing, developing, and firing the black paste and the white paste.

The transparent electrodes 1 are formed on a glass substrate 5 by, for example, ion sputtering, ion plating, chemical vapor deposition, or an electrode position technique with a material of $SnO_2$ or ITO. Such transparent electrode structures and forming methods are well known in the field of PDP technology.

Figure 2:
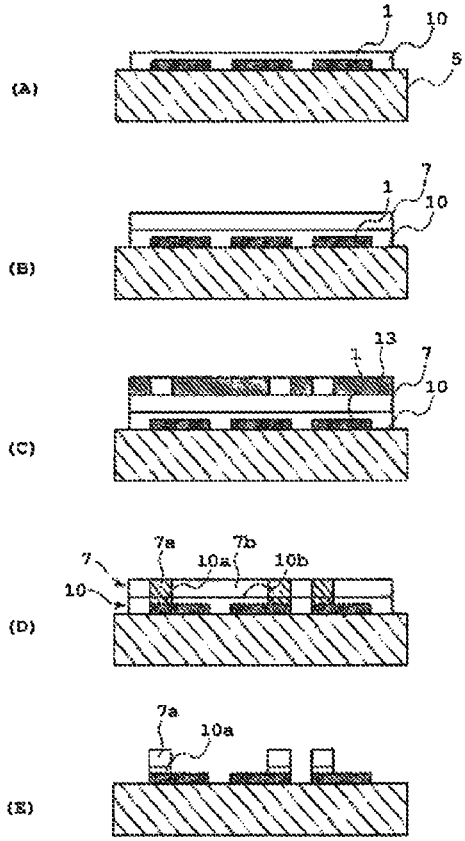
FIG. 2A to 2E illustrate an embodiment of the method of manufacturing a PDP bus electrode.

The black paste 10 is applied over the transparent electrodes 1 on the glass substrate 5 (FIG. 2A). In the event the transparent electrode 1 is omitted, the black paste is directly applied on the glass substrate 5. The thickness of the black paste layer which is just applied onto the glass substrate is 1 to 20 μm in an embodiment. The black paste layer 10 can be optionally dried in an oven.

The white paste 7 is applied onto the black paste layer 10 (FIG. 2B). The thickness of the white paste layer 7 which is just applied onto the black paste layer 10 is 1 to 20 μm in an embodiment. The applied white paste 7 can be optionally dried in an oven.

The way of applying the black paste and the white paste can be screen printing that could apply a paste onto a substrate in a short time.

The black paste layer 10 and the white paste layer 7 are exposed to light through a photo mask 13 with a desired pattern for the bus electrode (FIG. 2C). The light such as ultraviolet light is irradiated through a photo mask 13. The gap between the photo mask 13 and the white paste layer 10 can be 0 to 600 μm. The exposing condition can be controlled according to photosensitivity of the pastes and thickness of the paste layers 7, 10.

For a fine pattern, cumulative exposure is 50 to 2000 $mJ/cm^2$ in an embodiment, 70 to 1000 $mJ/cm^2$ in another embodiment, 100 to 500 $mJ/cm^2$ in another embodiment. The exposed area of the black paste layer 10*a* and white paste layer 7*a* as the pattern of the photo mask 13 are cured (FIG. 2D).

The black paste layer 10 and the white paste layer 7 are developed with an aqueous solution. The aqueous solution is, for example, an alkaline aqueous solution such as 0.4 wt % sodium carbonate solution. The aqueous solution can be sprayed to the paste layers to remove the unexposed area of the paste layers 7*b*, 10*b* so that the cured pattern 7*a*, 10*a* shows up (FIG. 2E). In an embodiment, the alkaline solution 112 is sprayed at 0.1 to 0.4 MPa for 5 to 100 seconds.

The patterned black paste layer 10*a* and white paste layer 7*a* after the development is optionally dried. The drying condition can be 50 to 250° C. for 1 to 60 minutes in an oven or drier in an embodiment.

The bus electrode containing the black electrode and the white electrode is obtained by firing the black paste layer 10*a* and the white paste layer 7*a* after exposure to light and development. The firing peak temperature is 450 to 700° C. in an embodiment, 510 to 680° C. in an embodiment. The firing peak temperature is the peak temperature when a bare glass substrate on which only the thermocouple was set at the center. The center is the cross point of the width direction and the length direction of the upper surface of the glass substrate.

The firing time at the peak temperature is 1 to 30 minutes in an embodiment, 5 to 20 minutes in another embodiment. The thickness of the black electrode is 0.5 to 15 μm in an embodiment. The thickness of the white electrode is 0.5 to 15 μm in an embodiment.

During the firing, the black colorant in the black paste layer could disperse into the white paste layer, which could increase electrode resistances and could deteriorate the blackness of the electrode. The black paste containing the second glass frit having Ts higher than the firing peak temperature could reduce dispersion of the black colorant into the white paste layer, which results in improvement of the blackness and electrical properties of the PDP bus electrode as shown in Example.

Black Paste

The materials of the black paste are described below. The term "Black" can also be represented by an L-value that is lower than the white paste or the white electrode.

(i) Black Colorant

The black colorant is any material that can make "black paste" and "black electrode" black enough for the contrast. To render sufficient blackness, the black colorant is 6 to 20 wt % based on the weight of the black paste. The black colorant is 8 to 15 wt % based on the weight of the black paste in another embodiment.

The black colorant can comprise cobalt oxide ($Co_3O_4$), chromium-copper-cobalt (Cr—Cu—Co) oxides, chromium-copper-manganese (Cr—Cu—Mn) oxides, chromium-iron-cobalt (Cr—Fe—Co) oxides, ruthenium (Ru) oxides, ruthenium pyrochlore, lanthanum oxides (ex. $La_{1-x}Sr_xCoO_3$), vanadium oxides (ex. $V_2O_3$, $V_2O_4$, $V_2O_5$) or a mixture thereof. The black colorant is $Co_3O_4$ which is relatively inexpensive and has sufficient blackness in another embodiment.

(ii) First Glass Frit

The glass frit is an inorganic amorphous material made by cooling a meltage. The glass frit is not necessary to be entirely amorphous. Partially crystallized glass frit can be included.

The black paste comprises 15 to 32 wt % of a first glass frit based on the weight of the black paste. The first glass frit is 18 to 30 wt % in another embodiment, 20 to 28 wt % in another embodiment, and 22 to 27 wt % in another embodiment, based on the weight of the black paste. The black paste containing the first glass frit of such amount could be bound to the substrate.

The first glass frit has a first softening point (Ts) lower than the firing peak temperature to melt and adhere to the glass substrate during firing. The first Ts of the first glass frit is at least 50° C. lower than the firing peak temperature in an embodiment. The first Ts of the first glass frit is 350 to 650° C. in another embodiment, 370 to 630° C. in another embodiment, and 380 to 570° C. in still another embodiment.

The first Ts is determined by differential thermal analysis (DTA). To determine Ts by DTA in general, a sample glass frit is introduced with a reference material into a furnace to be heated at a constant rate of 5 to 10° C. per minute. The difference in temperature between the two is detected to investigate the evolution and absorption of heat from the material.

There is no restriction on the first glass frit composition. Either lead-containing glass frit or lead-free glass frit can be the first glass frit as long as having the Ts lower than the firing peak temperature. In another embodiment, the first glass frit is lead-free in view of environmental burden. The glass frit comprises one or more oxides selected from the group consisting of barium oxide (BaO), tin oxide (SnO), vanadium oxide ($V_2O_3$), phosphorus oxide ($P_2O_5$), antimony oxide ($Sb_2O_3$), silicon oxide ($SiO_2$), zinc oxide (ZnO), boron oxide ($B_2O_3$), aluminum oxide ($Al_2O_3$), bismuth oxide ($Bi_2O_3$) and a mixture thereof.

The particle size (D50) of the first glass frit is 0.1 to 10 μm in an embodiment, 0.3 to 3 μm in another embodiment as measured by Microtrac. The first glass frit of such particle diameter can disperse uniformly and melt properly. D50 represents the point at which half of the glass frit particles are smaller than the value of D50 and the half are larger than the value of D50.

(iii) Second Glass Frit

The second glass frit has the second Ts higher than the firing peak temperature. The black paste containing the second glass frit having such Ts could form a bus electrode with a superior blackness as well as electrical properties as shown in Example below.

The second Ts of the second glass frit is at least 50° C. higher than the firing peak temperature in an embodiment. The softening point of the second glass frit is 550 to 1100° C. in an embodiment, 600 to 920° C. in another embodiment, and 650 to 870° C. in still another embodiment. The second Ts can be determined by DTA as well as the first Ts.

There is no restriction on the second glass frit composition. Either lead-containing glass frit or lead-free glass frit can be the first glass frit as long as having high Ts. In an embodiment, the second glass frit is the lead-free in view of environmental requirement.

The second glass frit comprises one or more oxides selected from the group consisting of silicon oxide ($SiO_2$), boron oxide ($B_2O_3$), aluminum oxide ($Al_2O_3$), barium oxide (BaO) and a mixture thereof in an embodiment.

In an embodiment, the second glass frit comprises $SiO_2$, CaO and BaO in the range of 50 to 95 wt %, in another embodiment 55 to 80 wt %, in another embodiment 60 to 72 wt %, based on the weight of the glass frit composition. In another embodiment, the second glass frit comprises $SiO_2$, $Al_2O_3$ and $B_2O_3$ in the range of 65 to 95 wt %, 70 to 89 wt % in another embodiment, 75 to 85 wt % in another embodiment, based on the weight of the glass frit composition. The particle size (D50) of the second glass frit is 0.1 to 10 μm in an embodiment, 0.5 to 6 μm in another embodiment, 0.5 to 3 μm in another embodiment as measured by Microtrac. The second glass frit of such particle diameter can disperse uniformly.

The second glass frit is 1 to 10 wt % based on the weight of the black paste. The second glass frit is 1.2 to 8 wt % in another embodiment, and 1.5 to 7 wt % in another embodiment based on the weight of the black paste. The second glass frit with the proper amount could render advantages to the bus electrode as described above.

Exemplary embodiments of the first glass frit composition and the second glass frit compositions, in weight percent (wt %) based on the weight of the glass frit composition, are shown in Table 1. The first glass frit and the second glass frit can be selected from the examples in Table 1 in view of adequate Ts.

TABLE 1

| # | Ts (° C.) | $SiO_2$ | $Al_2O_3$ | $B_2O_3$ | CaO | ZnO | MgO | $Na_2O$ | $K_2O$ | $Li_2O$ | $ZrO_2$ | $Bi_2O_3$ | BaO | SnO | $V_2O_3$ | $P_2O_5$ | $Sb_2O_3$ | total |
|---|---|---|---|---|---|---|---|---|---|---|---|---|---|---|---|---|---|---|
| 1 | 350 | | | | | | | | | | | | | 50.0 | | 50.0 | | 100 |
| 2 | 396 | | | | | | | | | | | | 3.0 | | 57.0 | 20.0 | 20.0 | 100 |
| 3 | 400 | 5.0 | | 15.0 | | | | | | | | 80.0 | | | | | | 100 |
| 4 | 445 | | | | | | | | | | | | 22.0 | | 48.0 | 25.0 | 5.0 | 100 |
| 5 | 505 | 10.0 | 3.0 | 12.0 | | 3.0 | | | | | 5.0 | 67.0 | | | | | | 100 |
| 6 | 525 | 15.0 | 5.0 | 25.0 | 15.0 | | 10.0 | | | | | | 30.0 | | | | | 100 |
| 7 | 601 | 18.4 | 9.0 | 18.1 | | 49.9 | | 1.1 | | 1.3 | 2.2 | | | | | | | 100 |
| 8 | 670 | 29.0 | 18.0 | 13.0 | 13.0 | 27 | | | | | | | | | | | | 100 |
| 9 | 720 | 45.0 | 14.0 | 9.0 | | 20 | 12 | | | | | | | | | | | 100 |
| 10 | 768 | 63.0 | 7.0 | 4.0 | 9.0 | | 7.0 | 10.0 | | | | | | | | | | 100 |
| 11 | 834 | 63.0 | 12.0 | 3.0 | 9.0 | | 5.0 | 8.0 | | | | | | | | | | 100 |
| 12 | 880 | 15.0 | 15.0 | 50.0 | | 10.0 | 10.0 | | | | | | | | | | | 100 |
| 13 | 930 | 85.0 | | 12.0 | | | | | 3.0 | | | | | | | | | 100 |
| 14 | 950 | 83.0 | | 10.0 | | | | | 7.0 | | | | | | | | | 100 |
| 15 | 1000 | 50.0 | 35.0 | | | | 15.0 | | | | | | | | | | | 100 |
| 16 | 1050 | 85.0 | | | | | | | 15.0 | | | | | | | | | 100 |

The glass frit, in general, can be prepared by the mixing and melting of raw materials such as oxides, hydroxides, carbonates, making into a cullet by quenching, mechanical pulverization, then drying in the case of wet pulverization. Thereafter, if needed, classification is carried out to the desired size. For the glass frit composition and the glass frit preparation, US20090042715 and US20100167032 can be herein incorporated by reference.

(iv) Photopolymerization Initiator

The photopolymerization initiator is a chemical compound that absorbs photo energy to be excited state and generate a radical. The photopolymerization initiator is thermally inactive at 185° C. or lower, but it generates free radicals when it is exposed to an actinic ray. A compound that has two intramolecular rings in the conjugated carboxylic ring system can be used as the photo-polymerization initiator.

The photopolymerization initiator is selected from the group consisting of Ethyl 4-dimethyl aminobenzoate (EDAB), diethylthioxanthone (DETX), 2-methyl-[4-(methylthio)-phenyl]-2-morphorino-1-propanone (MMPMP), 9,10-anthraquinone, 2-methyl anthraquinone, 2-ethyl anthraquinone, 2-t-butyl anthraxquinone, 1,4-dimethyl anthraquinone, 2,3-dimethyl anthraquinone, 2-phenyl anthraquinone, 2,3-diphenyl anthraquinone, retenquinone, 7,8,9,10-tetrahydronaphthacene-5,12-dione, and a mixture thereof in an embodiment.

The photopolymerization initiator is 1 to 10 wt % based on the weight of the black paste. In another embodiment, the photopolymerization initiator is 2 to 7 wt % based on the weight of the black paste.

(v) Photopolymerization Compound

The photopolymerizable compound is a monomer or an oligomer that chemically binds to other monomer or oligomer to form a polymer. The photopolymerization compound could comprise ethylenic unsaturated compounds having at least one polymerizable ethylene group in an embodiment.

The photopolymerization compound can be selected from the group consisting of ethocylated (3) trimethylolpropane triacrylate, dipentaerythritol pentaacrylate t-butyl(meth) acrylate, ethylene glycol di(meth)acrylate, 1,4-butanediol di(meth)acrylate, diethylene glycol di(meth)acrylate, hexamethylene glycol di(meth)acrylate, glycerol di(meth)acrylate, tripropylene glycol di(meth)acrylate, glycerol tri(meth)acrylate, trimethylol propane tri(meth)acrylate, a modified trifunctional polyether acrylate and a mixture thereof.

The photopolymerizable compound is 6 to 18 wt % based on the weight of the black paste. In another embodiment, the photopolymerizable compound is 8 to 16 wt % based on the weight of the black paste.

(vi) Organic Medium

The inorganic powders such as the black colorant and the glass frit are dispersed into the organic medium to form a viscous composition called "paste", having suitable viscosity for applying on a substrate with a desired pattern. The organic medium can burn off during the firing.

The organic medium is 20 to 60 wt % based on the weight of the black paste. In another embodiment, the organic medium is 35 to 50 wt % based on the weight of the black paste.

The organic medium contains an organic polymer and optionally a solvent in an embodiment. The organic polymer is composed of repeating structural units comprising carbon atoms in the main frame. The solvent contains any liquid that can dissolve the organic polymer to adjust the paste viscosity.

In an embodiment, the organic polymer contains acrylic polymer having a side chain of a hydroxyl group or a carboxyl group which can be soluble in the alkaline solution such as 0.4% sodium carbonate solution. The acrylic polymer can be copolymer of methyl methacrylate and methacrylic acid (MMA-MAA) in an embodiment. A cellulose polymer such as hydroxyethyl cellulose, hydroxypropyl cellulose and hydroxyethyl hydroxypropyl cellulose that is water-soluble can be also available. The organic polymer can be a mixture of the acrylic polymer and the cellulose polymer.

Solvent such as Texanol and Terpineol can be used to adjust the viscosity of the black paste to be preferable for applying onto the substrate. The viscosity of the conductive paste can be 5 to 300 Pascal second measured on a viscometer Brookfield HBT using a spindle #14 at 10 rpm at room temperature in an embodiment.

(vii) Metal Powder

The black paste can optionally contain a metal powder. The metal powder is made of any conductive metal having electrical conductivity.

Especially in the event the transparent electrode is formed on a glass substrate, the black paste can contain the metal powder to ensure the vertical conductivity between the transparent electrode and the white electrode.

The metal powder is 0.01 to 3 wt % in an embodiment, 0.03 to 1 wt % in another embodiment based on the weight of the black paste.

The metal powder comprises gold (Au), silver (Ag), platinum (Pt), palladium (Pd), copper (Cu), aluminum (Al), nickel (Ni), tungsten (W), a combination thereof or an alloy thereof in an embodiment. In terms of conductivity, the metal powder is Au, Pt, Ag, Pd, a combination thereof or an alloy thereof in another embodiment. The metal powder comprises silver-palladium (Ag—Pd) alloy, silver-platinum (Ag—Pt) alloy, Ag—Pt—Pd alloy, Pt—Pd alloy in another embodiment.

The metal powder has particle diameter (D50) from 0.1 to 10 μm in an embodiment. The metal powder with such D50 can be uniformly dispersed in the black paste enough to contribute to the vertical conductivity of the black electrode.

(viii) Additive

The black paste could further comprise additives such as a dispersant, stabilizer, plasticizer, stripping agent, surfactant and wetting agents.

For the black paste components other than the second glass frits, US20090033220, US20090108752 and US20100283388 can be herein incorporated by reference.

White Paste

The term "White" can also be represented by an L-value that is relatively higher than the black paste or the black electrode. The white paste can contain an electrically conductive powder, a glass frit, photopolymerization initiator, photopolymerizable compound, and organic medium in an embodiment. There is no restriction on the composition of the white paste so that any type of white paste can be available to form the white electrode on the black electrode.

In an embodiment, the electrically conductive powder is 50 to 75 wt %; the glass frit is 2 to 9 wt %; the photopolymerization initiator is 0.5 to 4 wt %; the photopolymerizable compound is 5 to 12 wt %; the organic medium is 15 to 29 wt %.

For the white paste composition, US20100167032, US20080012490 and US20110003246 can be herein incorporated by reference.

EXAMPLE

The invention is illustrated in further detail below with examples. The examples are for illustrative purposes only, and are not intended to limit the invention.

1. Black Paste Preparation

Texanol and an acrylic polymer were mixed and stirred at 100° C. to form an organic medium. 4 wt % of a photopolymerization initiator a mixture of Ethyl 4-dimethyl aminobenzoate (EDAB), diethylthioxanthone (DETX), and 2-methyl-[4-(methylthio)-phenyl]-2-morphorino-1-propanone (MMPMP) and 0.5 wt % of a stabilizer were added to 44.9 wt % of the organic medium which was cooled down to 75° C. The mixture was filtered through a 40 micron mesh. 12 wt % of a modified trifunctional polyether acrylate (Laromer® LR8967 from BASF) as a photopolymerizable monomer was added to the mixture and again mixed in a mixing tank.

10 wt % of cobalt oxide ($Co_3O_4$) powder, 0.1 wt % of Ag—Pd alloy powder (K8015-15 from Ferro: 85% silver/15% palladium powder), and 28.5 wt % of a glass frit were then added to the organic components mixture. The "wt %" above is based on the weight of the black paste unless especially mentioned.

The glass frit consisted of the first glass frit having the Ts of 460° C. and the second glass frit A having the Ts of 850° C. or the second glass frit B having the Ts of 800° C. as in Table 2. The second glass A contained 68 wt % of $SiO_2$, CaO and BaO in total based on the glass frit composition. The second glass B contained 80 wt % of $SiO_2$, $Al_2O_3$ and $B_2O_3$ in total based on the glass frit composition. D50 of the all glass frits were 1.2 μm.

The entire black paste was mixed until the inorganic materials were wet with the organic material. The mixture was dispersed using a 3-roll mill. The resulting paste was filtered through a 20 μm filter. The processes were carried out under yellow light.

2. Forming Electrode

Precautions were taken to avoid dirt contamination, as contamination by dirt during the preparation of the paste and the manufacture of the parts would have resulted in defects.

2-1. Applying

The black electrode paste was screen printed on an ITO layer formed on a glass substrate with size of 50 mm square and 2.3 mm thick through a mesh screen to form a 40 mm square pattern. The printed black paste was dried at 120° C. for 10 minutes.

A white paste containing, based on the weight of the white paste, 65 wt % of silver powder, 5 wt % of glass frit, 2 wt % of photopolymerization initiator, 8 wt % of photopolymerizable monomer, 20 wt % of organic medium was applied onto the dried black paste through the mesh screen to form a 40 mm square pattern. The printed white paste was dried at 120° C. for 10 minutes as well.

2-2. Exposure

The paste layers were exposed to UV light of 365 nm wave length by using a collimated UV radiation source (exposure: 200 mJ/cm$^2$) through a photo-mask. The photo-mask had S-shaped line with 100 μm wide and 333 mm long.

2-3. Development

Figure 3:
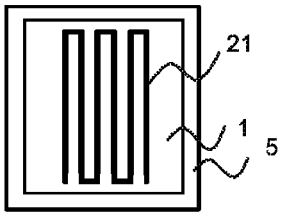
FIG. 3 illustrates a pattern of the bus electrode to measure line resistance in Example.

The exposed paste layers were placed on a conveyor going in a spray developing device filled with 0.4% sodium carbonate aqueous solution which was kept at a temperature of 30° C., and was sprayed at 0.2 MPa for 40 seconds to the exposed paste layer. The patterned paste layers 21 on the ITO layer 5 formed on the glass substrate 5 after the development was the S-shaped line as shown in FIG. 3.

2-4. Firing

The S-shaped line pattern formed by the development was fired in a furnace (Roller Hearth Continuous Furnaces from KOYO THERMO SYSTEMS KOREA CO., LTD.) to be a PDP electrode. The firing peak temperature on the upper surface of the glass substrate was 600° C. measured with a thermocouple. The firing peak temperature was obtained by firing a bare glass substrate, 50 mm wide, 75 mm long, 2.3 mm thick, on which only the thermocouple was set at the center on the upper surface. The center was the cross point of the width direction and the length direction that was 2.5 mm to the width direction and 3.25 mm to the length direction.

The firing peak temperature was kept for 10 minutes. The total firing time, from entrance to exit of the furnace, was 1.5 hours. The bus electrode had thickness of 4.5 μm in average.

3. Measurement

L-Value

The L-value of the PDP electrode at both sides of the white electrode surface and the black electrode surface through the glass substrate were measured by using a device, Colorimetric SE2000 from Nippon Denshoku Industry Co., Ltd. A standard white plate was used for calibration. L-value of 100 indicates pure white, and 0 indicates pure black.

Line Resistance

The line resistance (Ω) was measured the 4-terminal method using a multimeter (34401A from Hewlett-Packard Company) between the both ends of the bus electrode.

Contact Resistance

Figure 4:
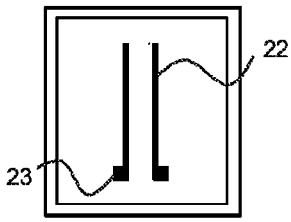
FIG. 4 illustrates a pattern of the bus electrode to measure contact resistance in Example.

Besides the PDP electrode to measure the line resistance above, a special line pattern 22 of PDP electrode to measure contact resistance was formed in the same manner above except for using a different pattern of photo-mask at the exposure step as illustrated in FIG. 4. The line pattern 22 of the PDP electrode consisted of two lines of 80 μm wide and 20 mm long with space of 50 μm between the lines 22. The each line 22 had a 2 mm square pad 23. The contact resistance between the line patterned electrodes 22 was measured by the 4-terminal method using the multimeter (34401A from Hewlett-Packard Company) on the pads 23.

Result

The L-value of the white electrode surface was higher (whiter) in Example 1 to 3 than that in Comparative (Com.) Example 1, and the L-value of the black electrode surface was lower (blacker) in Example 1 to 3 than that in Com. Example 1. In other words, the dispersion of the black colorant in the black paste into the white electrode was prevented.

Both of the line resistance and the contact resistance in Example 1 to 3 were lower than those of Com. Example 1. Especially the contact resistance sharply lowered.

TABLE 2

| Component | Example 1 | Example 2 | Example 3 | Com. Example 1 |
|---|---|---|---|---|
| First glass frit Ts: 460° C. | 25.5 | 25.5 | 22.5 | 28.5 |
| Second glass frit A Ts: 850° C. | 3.0 | 0 | 0 | 0 |
| Second glass frit B Ts: 800° C. | 0 | 3.0 | 6.0 | 0 |
| L-value/white electrode** | 68 | 68 | 70 | 60 |
| L-value/black electrode* | 12 | 12 | 11 | 14 |
| Line resistance (Ω) | 41 | 41 | 40 | 43 |
| Contact resistance (Ω) | 15 | 20 | 15 | 60 |

*L-value measured on the surface of the black electrode from the side of the glass substrate

**L-value measured on the white electrode surface from the other side of the glass substrate

* L-value measured on the surface of the black electrode from the side of the glass substrate

** L-value measured on the white electrode surface from the other side of the glass substrate

What is claimed is:

1. A method of manufacturing a PDP bus electrode comprising steps of:

(a) applying onto a glass substrate a black paste comprising, based on the weight of the black paste, (i) 6 to 20 wt % of a black colorant, (ii) 15 to 32 wt % of a first glass frit having a first softening point, (iii) 1 to 10 wt % of a second glass frit having a second softening point, (iv) 1 to 10 wt % of a photopolymerization initiator, (v) 6 to 18 wt % of a photopolymerizable compound, and (vi) 20 to 60 wt % of an organic medium;

(b) applying a white paste onto the applied black paste;

(c) exposing the applied black paste and the applied white paste on the glass substrate to light;

(d) developing the exposed black paste and the white paste; and (e) firing the developed black paste and the developed white paste with a firing profile having a firing peak temperature to form a black electrode and a white electrode respectively, wherein the first softening point of the first glass frit is lower than the firing peak temperature and wherein the second softening point of the second glass frit is higher than the firing peak temperature.

2. The method of claim 1, wherein the softening point of the second glass frit is at least 50° C. higher than the firing peak temperature.

3. The method of claim 1, wherein the firing peak temperature is 450 to 700° C.

4. The method of claim 1, wherein the softening point of the second glass frit is 550 to 1100° C.

5. The method of claim 1, wherein the black paste further comprises a metal powder.

6. A PDP front panel comprising the bus electrode formed by the method of claim 1.

* * * * *